US009281635B2

(12) United States Patent
Beak et al.

(10) Patent No.: US 9,281,635 B2
(45) Date of Patent: Mar. 8, 2016

(54) CONNECTOR AND CONNECTOR BAR

(75) Inventors: SeungSeok Beak, Tokyo (JP); Koichi Kiryu, Nagano (JP); Takashi Yuba, Tokyo (JP); Daiei Iwamoto, Tokyo (JP); Akio Nakamura, Tokyo (JP); Masatoshi Noritake, Tokyo (JP); Keiichi Hirose, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 143 days.

(21) Appl. No.: 14/236,941

(22) PCT Filed: Aug. 10, 2012

(86) PCT No.: PCT/JP2012/070486

§ 371 (c)(1),
(2), (4) Date: Feb. 4, 2014

(87) PCT Pub. No.: WO2013/022089

PCT Pub. Date: Feb. 14, 2013

(65) Prior Publication Data

US 2014/0273637 A1 Sep. 18, 2014

(30) Foreign Application Priority Data

Aug. 11, 2011 (JP) ..... 2011-176410

(51) Int. Cl.
*H01H 15/00* (2006.01)
*H01H 15/06* (2006.01)
(Continued)

(52) U.S. Cl.
CPC ..... *H01R 13/71* (2013.01); *H01H 1/26* (2013.01); *H01H 13/52* (2013.01);
(Continued)

(58) Field of Classification Search
CPC ..... H01H 13/52; H01H 1/26; H01H 9/443; H01H 9/26; H01R 13/71; H01R 25/003; H01R 13/7132; H01R 15/102; H01R 13/14
USPC ..... 439/620.2, 620.21, 620.3, 652; 200/50.32, 252, 255, 293, 314, 325, 200/520, 547, 549
See application file for complete search history.

(56) References Cited

U.S. PATENT DOCUMENTS 5,648,646 A * 7/1997 Flegel ..... 200/50.32
6,552,286 B2 * 4/2003 Yang et al. ..... 200/330
(Continued)

FOREIGN PATENT DOCUMENTS

JP 03-037921 2/1991
JP 05-082208 4/1993
(Continued)

OTHER PUBLICATIONS

International Search Report mailed on Oct. 9, 2012.

*Primary Examiner* — Abdullah Riyami
*Assistant Examiner* — Harshad Patel
(74) *Attorney, Agent, or Firm* — IPUSA, PLLC

(57) ABSTRACT

A connector includes a connecting terminal, a fixed contact, a movable plate, a movable contact provided at an end of the movable plate, a card that includes an insulator and contacts the movable plate, a button that contacts the card, an opening spring connected to the button, and a sliding operation part that controls a contact between the fixed contact and the movable contact. When the sliding operation part is moved in a first direction, the movable contact is brought into contact with the fixed contact and the connector is turned on. When the sliding operation part is moved in a second direction opposite to the first direction, the movable contact is caused to move away from the fixed contact and the connector is turned off. The sliding operation part is provided on a surface that is different from a surface on which the connecting terminal is provided.

8 Claims, 19 Drawing Sheets

(51) Int. Cl.

| | |
|---|---|
| ***H01R 13/71*** | (2006.01) |
| ***H01R 13/713*** | (2006.01) |
| ***H01R 25/00*** | (2006.01) |
| ***H01H 1/26*** | (2006.01) |
| ***H01H 13/52*** | (2006.01) |
| *H01H 9/44* | (2006.01) |
| *H01H 15/24* | (2006.01) |
| *H01H 15/10* | (2006.01) |

(52) U.S. Cl.
CPC ..... *H01R 13/7132* (2013.01); *H01R 25/003* (2013.01); *H01H 9/443* (2013.01); *H01H 15/102* (2013.01); *H01H 15/24* (2013.01)

(56) References Cited

U.S. PATENT DOCUMENTS

| | | | | |
|---|---|---|---|---|
| 6,841,744 | B1 * | 1/2005 | Kodo et al. | 200/16 C |
| 8,664,553 | B2 * | 3/2014 | Yuba et al. | 200/268 |
| 2002/0112945 | A1 | 8/2002 | Lawson et al. | |
| 2010/0029110 | A1 * | 2/2010 | Kiryu et al. | 439/188 |
| 2011/0117762 | A1 | 5/2011 | Beak et al. | |
| 2013/0231007 | A1 * | 9/2013 | Iwamoto et al. | 439/620.21 |

FOREIGN PATENT DOCUMENTS

| | | |
|---|---|---|
| JP | 2003-031301 | 1/2003 |
| JP | 2004-521454 | 7/2004 |
| JP | 2011-108394 | 6/2011 |

* cited by examiner

CONNECTOR AND CONNECTOR BAR

TECHNICAL FIELD

The present invention relates to a connector and a connector bar.

BACKGROUND ART

Generally, an electric apparatus is driven by electric power supplied from a power supply. An electric apparatus typically receives electric power via a connector from a power supply. Patent documents 1 and 2 disclose a connector unit including a protruding male connector and a hollow female connector that are fitted together to be electrically connected.

In recent years, as a measure to cope with global warming, it is being considered to use, even for power transmission in local areas, a direct-current high-voltage power that suffers less power loss during voltage conversion and power transmission and does not necessitate increasing the diameter of a cable. Supplying electric power in this manner is particularly preferable for an information apparatus such as a server that consumes a large amount of electric power.

On the other hand, when electric power supplied to an electric apparatus has a high voltage, the electric power may affect the human body and operations of electronic components. When such a high-voltage power is used for an information apparatus such as a server that is installed and maintained by a human, it is necessary to use, for electric connection, a connector that is different from a connector used for a normal alternating-current commercial power supply.

RELATED-ART DOCUMENTS

Patent Documents

[Patent document 1] Japanese Laid-Open Patent Publication No. 05-82208

[Patent document 2] Japanese Laid-Open Patent Publication No. 2003-31301

DISCLOSURE OF INVENTION

Problems to be Solved by the Invention

When a connector includes a switch and the electric power supplied from a power supply has a voltage greater than or equal to 100V or is a direct-current high-voltage power, a currently-used switch cannot be used without change. For example, when the electric power supplied from a power supply has a direct-current voltage of 400 V, it is dangerous to use a switch for an alternating-current voltage of 100V without change because sufficient safety and reliability cannot be ensured.

The present invention is made taking into account the above described problems. One object of the present invention is to provide a connector and a connector bar that can safely supply a high-voltage power. More specifically, one object of the present invention is to provide a connector and a connector bar that are safe and reliable and support a direct-current power supply or a power supply with a voltage higher than the voltage of an existing commercial power supply.

Means for Solving the Problems

In an aspect of this disclosure, there is provided a connector that includes a connecting terminal to be connected with another connecting terminal of another connector; a fixed contact; a movable plate; a movable contact provided at an end of the movable plate; a card that includes an insulator and contacts the movable plate; a button that contacts the card; an opening spring connected to the button; and a sliding operation part that controls a contact between the fixed contact and the movable contact. One of the fixed contact and the movable contact is connected to the connecting terminal. The connector is configured such that when the sliding operation part is moved in a first direction, the button is pressed, the movable plate is moved via the card to bring the movable contact into contact with the fixed contact, and the connector is turned on; and when the sliding operation part is moved in a second direction opposite to the first direction, the movable contact is caused to move away from the fixed contact by a restoring force of the opening spring, and the connector is turned off. The sliding operation part is provided on a surface of the connector that is different from a surface of the connector on which the connecting terminal is provided.

Advantageous Effect of the Invention

An embodiment of the present invention provides a connector and a connector bar that support a direct-current power supply or a power supply with a voltage higher than the voltage of an existing commercial power supply, and that can safely supply electric power from such a power supply.

DESCRIPTION OF EMBODIMENTS

Embodiments of the present invention are described below. The same reference number is assigned to the same component throughout the accompanying drawings, and overlapping descriptions of the same component are omitted.

First Embodiment

Configuration of Connector

A configuration of a connector according to a first embodiment is described. A connector of the present embodiment is to be connected to another connector, which is a plug connector illustrated by FIGS. 1 through 5, and corresponds to a jack connector whose configuration is illustrated by FIGS. 6 through 21. The plug connector illustrated by FIGS. 1 through 5 and the connector corresponding to the jack connector illustrated by FIGS. 6 through 21 may be collectively referred to as a "connector set".

Figure 1:
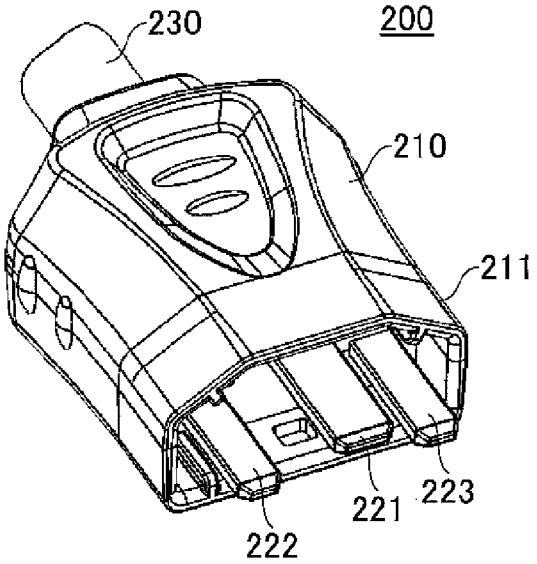
FIG. 1 is a perspective view of a plug connector according to a first embodiment.
Figure 2:
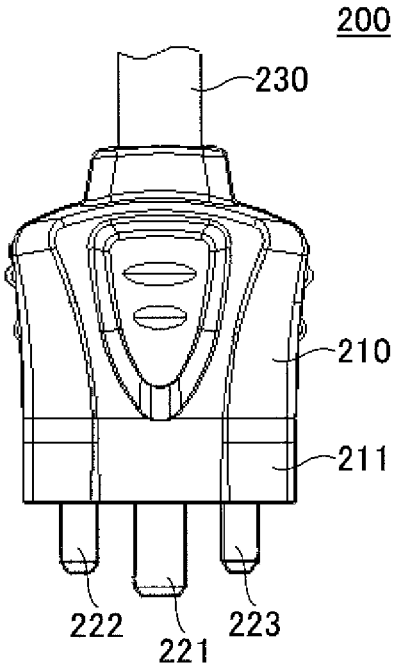
FIG. 2 is a top view of the plug connector according to the first embodiment.
Figure 3:
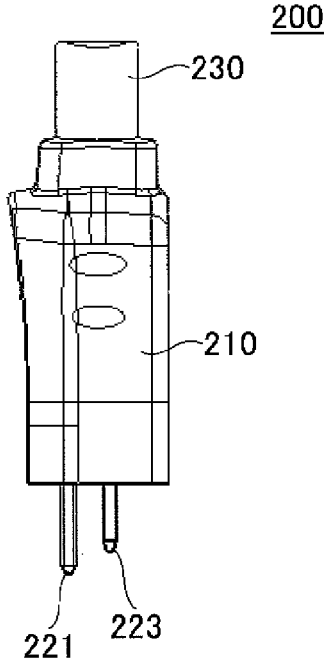
FIG. 3 is a side view of the plug connector according to the first embodiment.
Figure 4:
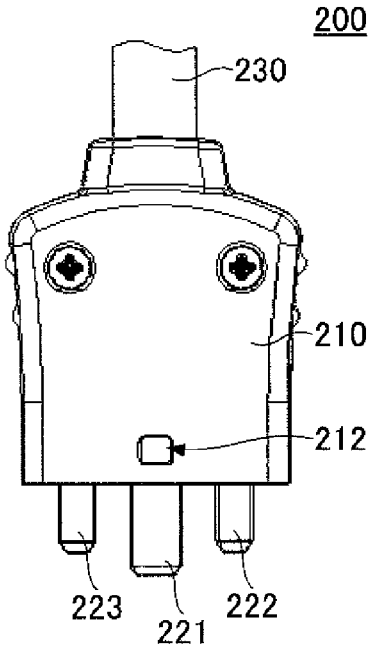
FIG. 4 is a bottom view of the plug connector according to the first embodiment.
Figure 5:
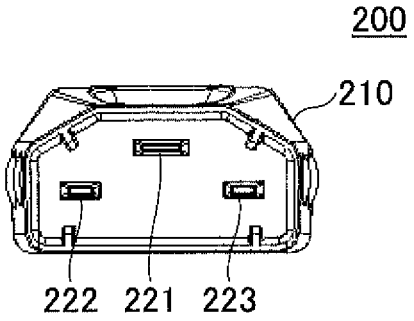
FIG. 5 is a front view of the plug connector according to the first embodiment.

First, a plug connector 200 is described with reference to FIGS. 1 through 5. FIG. 1 is a perspective view, FIG. 2 is a top view, FIG. 3 is a side view, FIG. 4 is a bottom view, and FIG. 5 is a front view of the plug connector 200. The plug connector 200 includes a cover 210 composed of, for example, an insulator and three plug terminals 221, 222, and 223 that are referred to as "other connecting terminals". A power cable 230 is connected to a side of the plug connector 200 that is opposite to a side where the three plug terminals 221, 222, and 223 are provided. The plug terminal 221 is a GND terminal and longer than the plug terminals 222 and 223. The plug terminals 222 and 223 are terminals to which electric power is supplied when they are electrically connected to jack terminals. A part of the cover 210, which is near the side where the plug terminals 221, 222, and 223 are provided, forms a protection part 211 that covers parts of the plug terminals 221, 222, and 223. Also, a connector connection opening 212 is formed in the protection part 211. The connector connection opening 212 prevents the plug connector 200 from being disconnected from a connector of the present embodiment.

Figure 6:
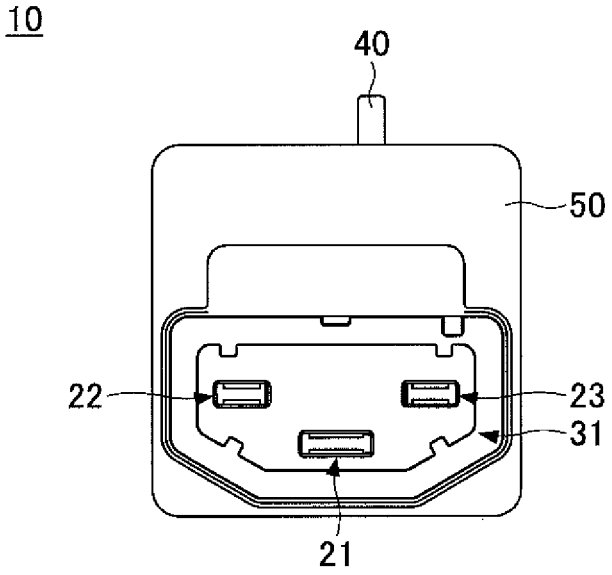
FIG. 6 is a top view of a connector according to the first embodiment.
Figure 7:
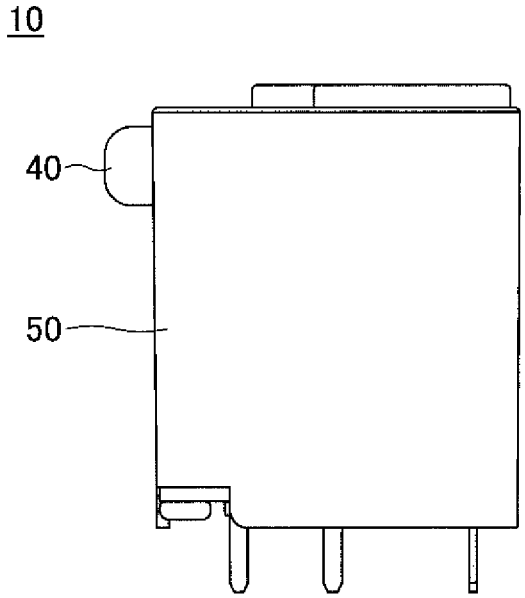
FIG. 7 is a right side view of the connector of the first embodiment.
Figure 8:
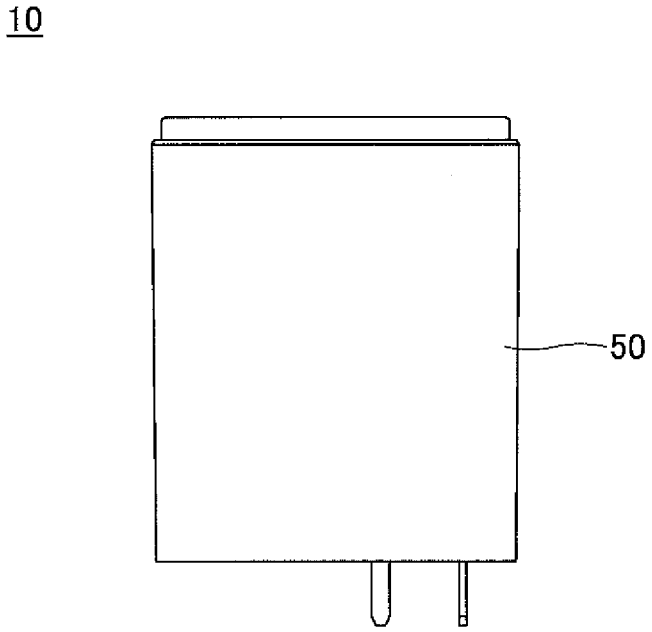
FIG. 8 is a rear view of the connector of the first embodiment.
Figure 9:
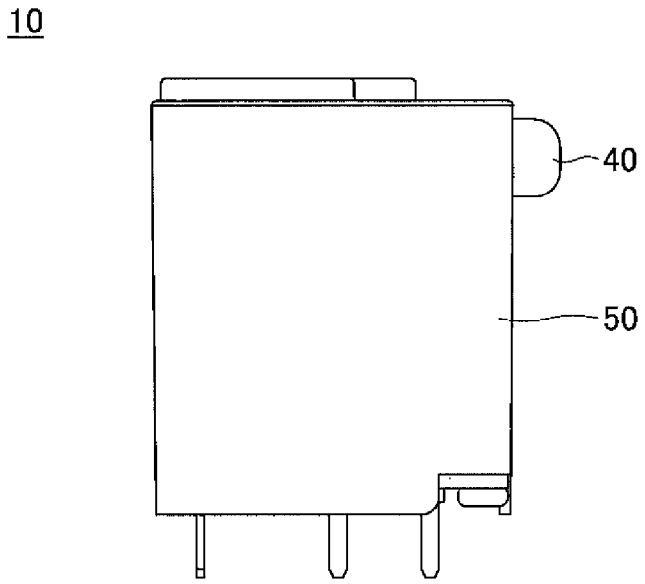
FIG. 9 is a left side view of the connector of the first embodiment.
Figure 10:
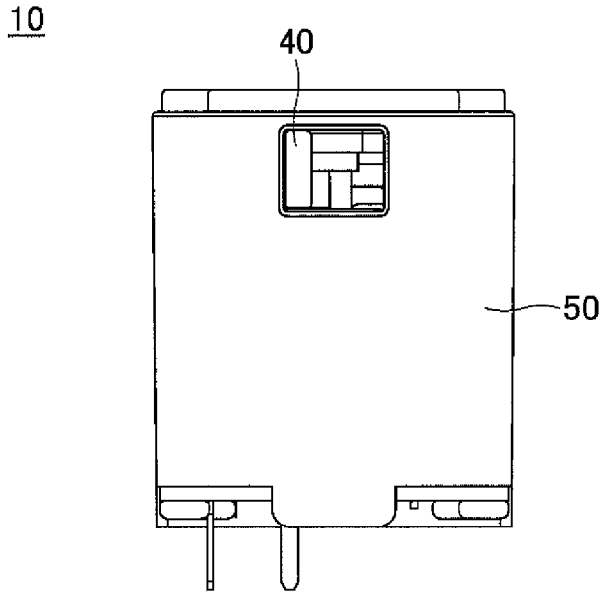
FIG. 10 is a front view of the connector according to the first embodiment.
Figure 11:
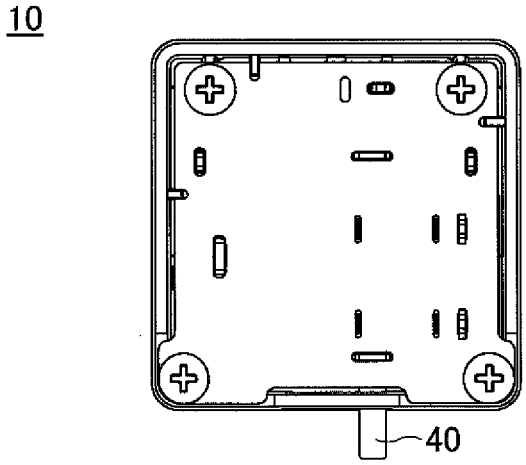
FIG. 11 is a bottom view of the connector of the first embodiment.
Figure 12:
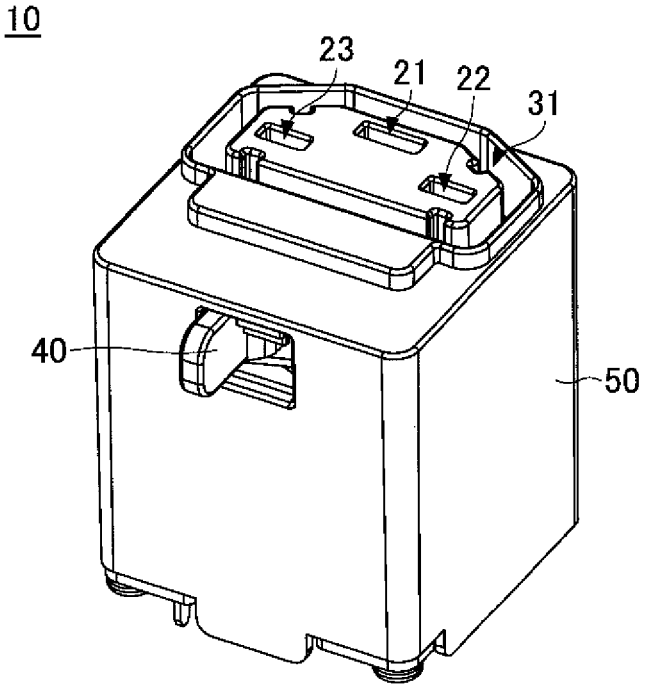
FIG. 12 is a perspective view (1) of the connector according to the first embodiment.
Figure 13:
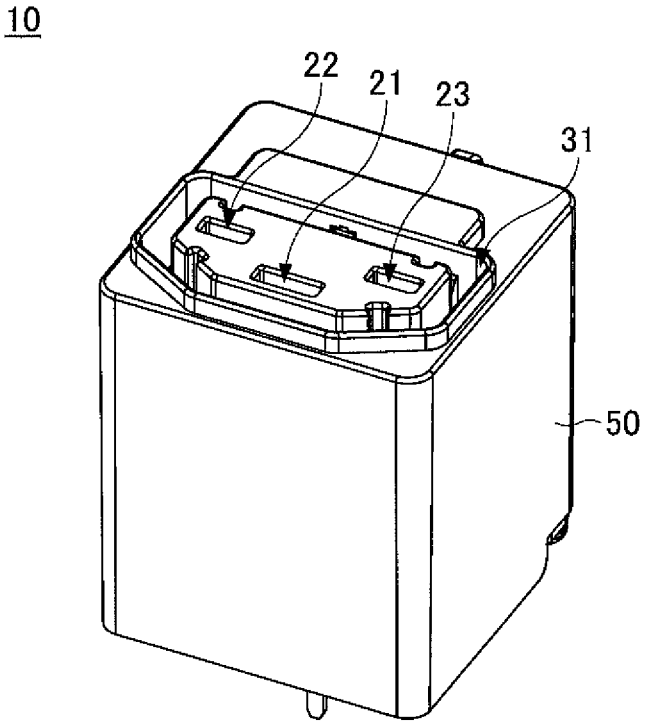
FIG. 13 is a perspective view (2) of the connector according to the first embodiment.
Figure 14:
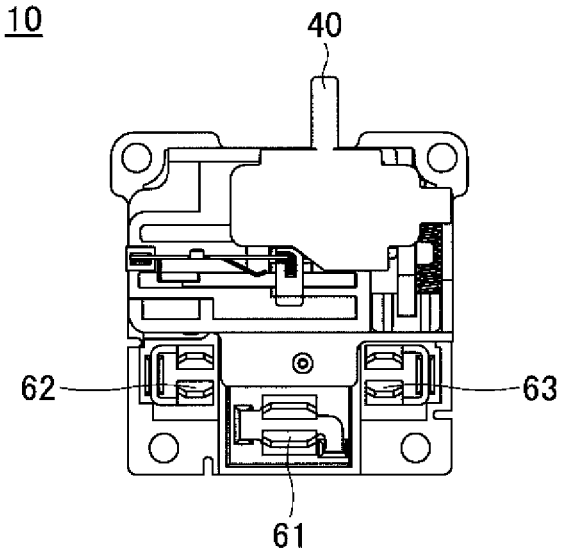
FIG. 14 is a top view of an inside of the connector according to the first embodiment.
Figure 15:
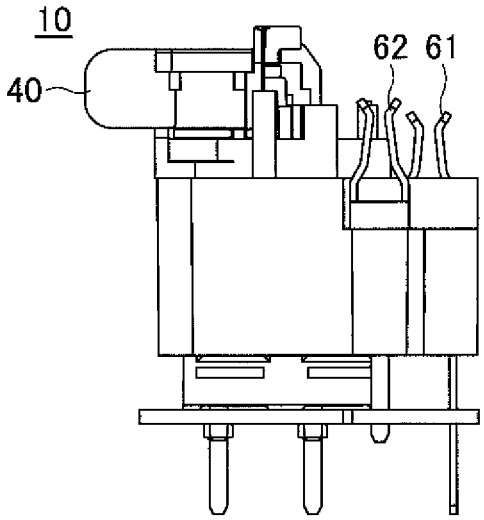
FIG. 15 is a right side view of the inside of the connector according to the first embodiment.
Figure 16:
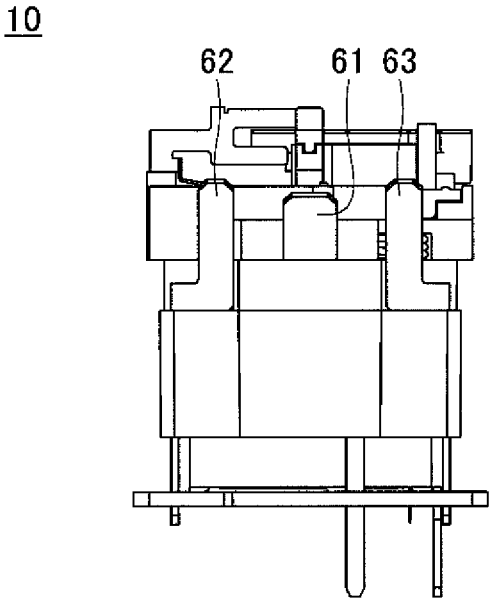
FIG. 16 is a rear view of the inside of the connector according to the first embodiment.
Figure 17:
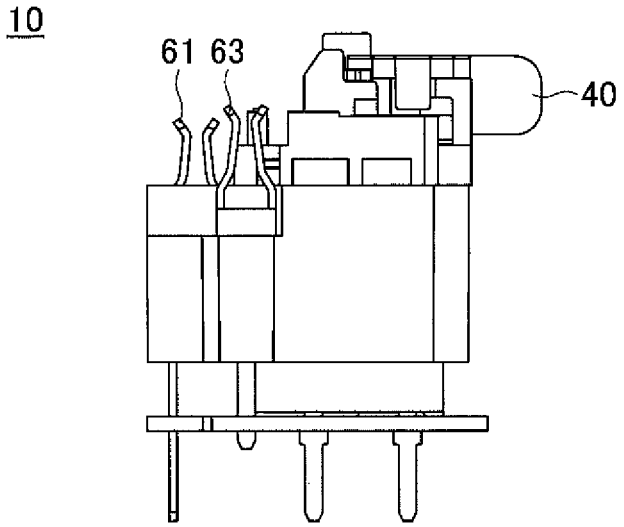
FIG. 17 is a left side view of the inside of the connector according to the first embodiment.
Figure 18:
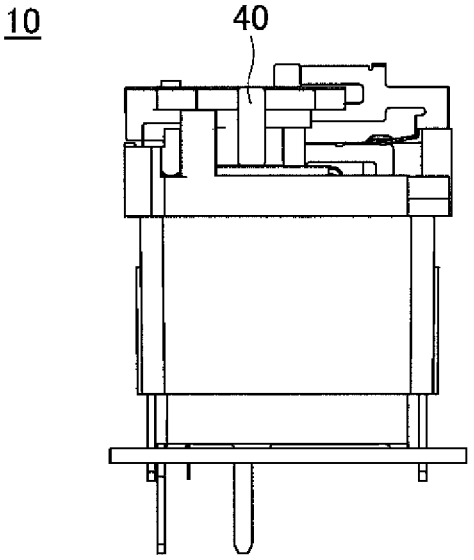
FIG. 18 is a front view of the inside of the connector according to the first embodiment.
Figure 19:
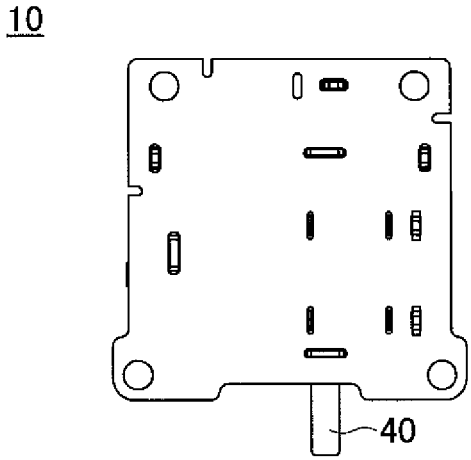
FIG. 19 is a bottom view of the inside of the connector according to the first embodiment.
Figure 20:
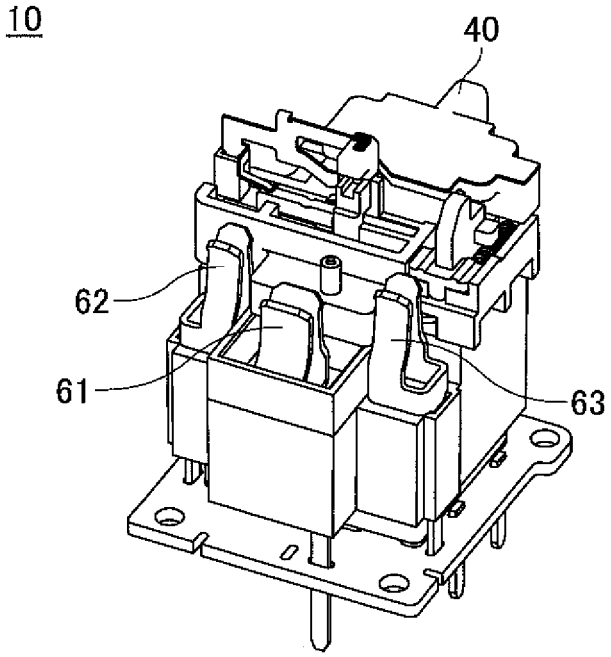
FIG. 20 is a perspective view (1) of the inside of the connector according to the first embodiment.
Figure 21:
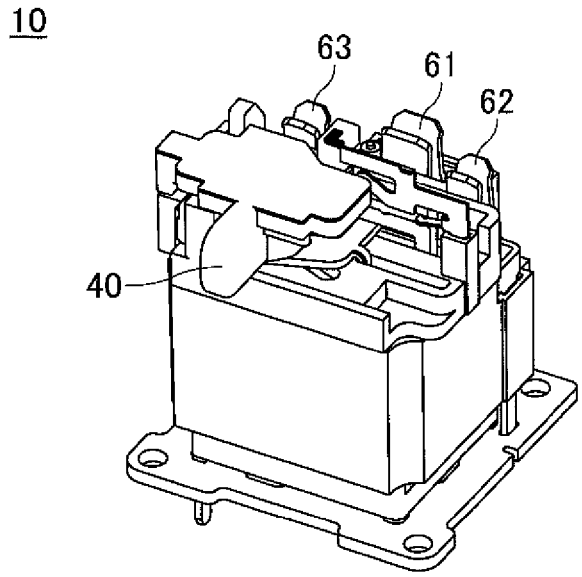
FIG. 21 is a perspective view (2) of the inside of the connector according to the first embodiment.

Next, a connector 10 of the present embodiment is described with reference to FIGS. 6 through 21. FIG. 6 is a top view, FIG. 7 is a right side view, FIG. 8 a rear view, FIG. 9 is a left side view, FIG. 10 is a front view, and FIG. 11 is a bottom view of the connector 10 of the present embodiment. FIG. 12 is a front perspective view and FIG. 13 is a rear perspective view of the connector 10 of the present embodiment. FIG. 14 is a top view, FIG. 15 is a right side view, FIG. 16 a rearview, FIG. 17 is a left side view, FIG. 18 is a front view, and FIG. 19 is a bottom view of the inside of the connector 10 of the present embodiment. FIG. 20 is a front perspective view and FIG. 21 is a rear perspective view of the inside of the connector 10 of the present embodiment.

The connector 10 of the present embodiment is covered by a case 50, and includes jack openings 21, 22, and 23 into which the plug terminals 221, 222, and 223 of the plug connector 200 are to be inserted; a groove into which the protection part 211 of the plug connector 200 is to be inserted; and a sliding operation part 40 that is a sliding switch for controlling the supply of electric power when the plug connector 200 and the connector of the present embodiment are connected to each other. According to the present embodiment, the sliding operation part 40 is provided on a surface other than a surface in which the jack openings 21, 22, and 23 are formed. For example, the sliding operation part 40 is provided on a surface that is adjacent to the surface in which the jack openings 21, 22, and 23 are formed. The sliding operation part 40 is slidable between an ON position and an OFF position. Whether electric power is supplied via the connector can be controlled by sliding the sliding operation part 40.

A jack terminal 61 is provided in the jack opening 21, a jack terminal 62 is provided in the jack opening 22, and a jack terminal 63 is provided in the jack opening 23. When the plug connector 200 is fitted into the jack connector, i.e., the connector of the present embodiment, the plug terminal 221 and the jack terminal 61 are fitted together and connected to each other, the plug terminal 222 and the jack terminal 62 are fitted together and connected to each other, and the plug terminal 223 and the jack terminal 63 are fitted together and connected to each other. Even in this state, when the sliding operation part 40 is at the OFF position, a switch (not shown) provided in the connector of the present embodiment and for controlling the connection between the jack terminals 62 and 63 and a power supply is open, and therefore electric power is not supplied via the jack terminal 62 to the plug terminal 222 and via the jack terminal 63 to the plug terminal 223.

On the other hand, when the sliding operation part 40 is slid to the ON position, the switch (not shown) provided in the connector of the present embodiment and for controlling the connection between the jack terminals 62 and 63 and the power supply is closed, and as a result electric power is supplied via the jack terminal 62 to the plug terminal 222 and via the jack terminal 63 to the plug terminal 223.

<Switch>

Figure 22:
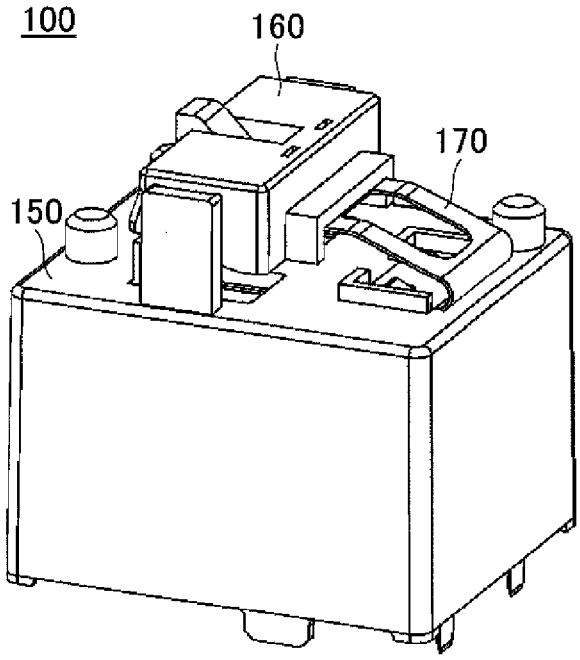
FIG. 22 is a perspective view of a switch.
Figure 23:
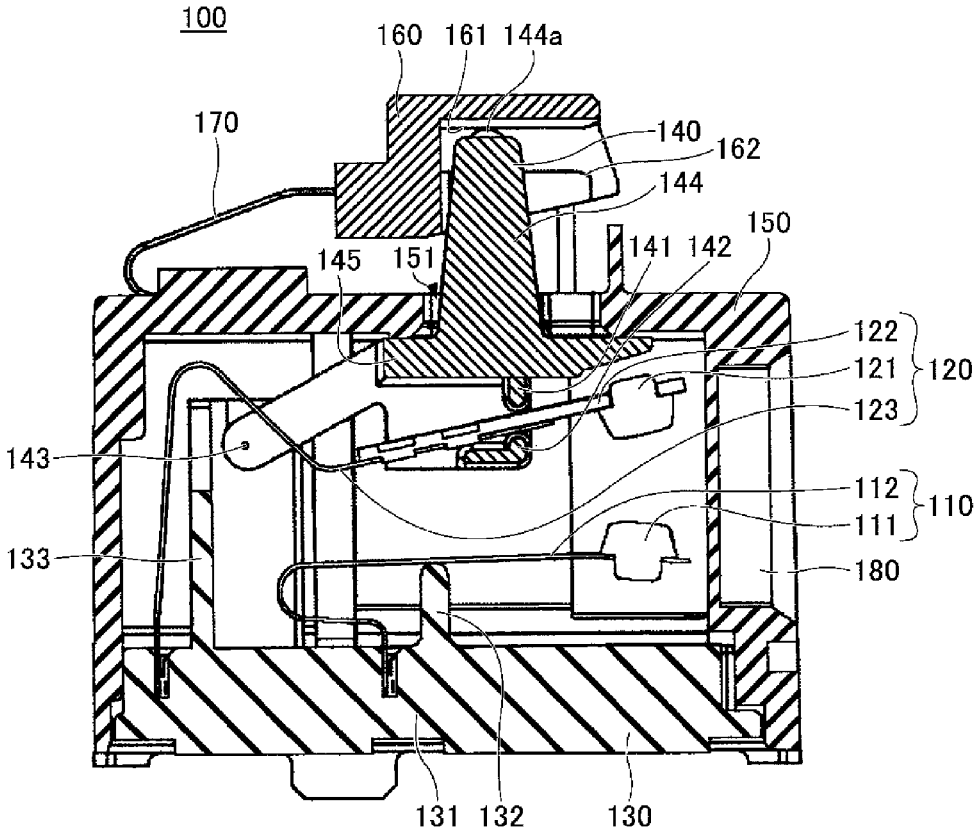
FIG. 23 is a drawing illustrating a configuration of the switch (OFF state)

Next, a switch 100 that is operated via the sliding operation part 40 is described. The switch 100 of the connector of the present embodiment controls supply of electric power, and is also referred to as a "power switch". FIG. 22 is a perspective view of the switch 100 and FIG. 23 illustrates the internal configuration of the switch 100. As illustrated by FIG. 23, the switch 100 controls contact between a fixed contact 111 of a fixed part 110 and a movable contact 121 of a movable part 120 to turn on and off the supply of electric power.

The fixed part 110 is composed of a conductive material such as metal, and includes a fixed spring 112 and the fixed contact 111 that is provided at a first end of the fixed spring 112 and to be brought into contact with the movable contact 121 of the movable part 120. The fixed spring 112 is formed by bending a metal plate composed of, for example, copper or an alloy including copper. The fixed contact 111 is composed of an alloy of silver and copper. A second end of the fixed spring 112 is fixed to a base block body 131 of a base block 130. The fixed spring 112 is also supported and fixed in the middle by a fixed part support 132.

The movable part 120 is composed of a conductive material such as metal, and includes a movable plate 122, a movable spring 123, and the movable contact 121 that is provided at a first end of the movable plate 122 and to be brought into contact with the fixed contact 111 of the fixed part 110. A second end of the movable plate 122 is connected to a first end of the movable spring 123. Each of the movable plate 122 and the movable spring 123 is formed by bending a metal plate composed of, for example, copper or an alloy including copper. The movable contact 121 is composed of an alloy of silver and copper. A second end of the movable spring 123 is fixed to the base block body 131 of the base block 130. However, because the movable spring 123 is formed by bending a metal plate and has flexibility, the movable contact 121 provided at the first end of the movable plate 122 can be moved in the vertical direction. An insulating wall 133 composed of, for example, a fire-retardant resin material is provided between a part of the base block 130 to which the second end of the fixed spring 112 is fixed and a part of the base block 130 to which the second end of the movable spring 123 is fixed. The movable spring 123 is bent such that it extends from the second end around a part of the insulating wall 133.

An upper surface, or a first surface, of the movable plate 122 of the movable part 120 is in contact with an upper contact part 141, or a first contact part, of a card 140. A lower surface, or a second surface, of the movable plate 122 is in contact with a lower contact part 142, or a second contact part, of the card 140. In this state, when the card 140 is rotated around a rotational shaft 143, the movable plate 122 contacts the upper contact part 141 or the lower contact part 142 and a force is applied to the movable plate 122. As a result, the movable contact 121 moves in the vertical direction. Because the upper contact part 141 and the lower contact part 142 are to slide on the movable plate 122, a surface layer of, for example, a fluoroplastic may be formed on the surface of each of the upper contact part 141 and the lower contact part 142 to reduce frictional resistance.

The fixed part 110 and the movable part 120 are disposed inside of an area surrounded by the base block 130 and a switch case 150. The card 140 includes a protrusion 144 that protrudes out of the switch case 150 through a switch opening 151 formed in the switch case 150, and a card body 145 disposed in the area surrounded by the base block 130 and the switch case 150. Accordingly, in the switch 100, the upper contact part 141 and the lower contact part 142 are disposed in the area surrounded by the base block 130 and the switch case 150. The card 140, the base block 130, and the switch case 150 are composed of an insulator material such as a resin.

A button 160 is provided outside of the switch case 150. When the button 160 is pressed, the card 140 is rotated around the rotational shaft 143. A contact part **144*a* is provided on an upper part of the protrusion 144 of the card 140. The contact part 144*a* is in contact with an inner wall 161 of the button 160. Because the contact part 144*a* is to slide on the surface of the inner wall 161, a surface layer of, for example, a fluoroplastic may be formed on the surface of the inner wall 161 to reduce frictional resistance. An opening spring 170 is provided outside of the switch case 150. One end of the opening spring 170 is connected to the switch case 150, and another end of the opening spring 170 is connected to the button 160**.

<On and Off Operations of Switch>

Figure 24:
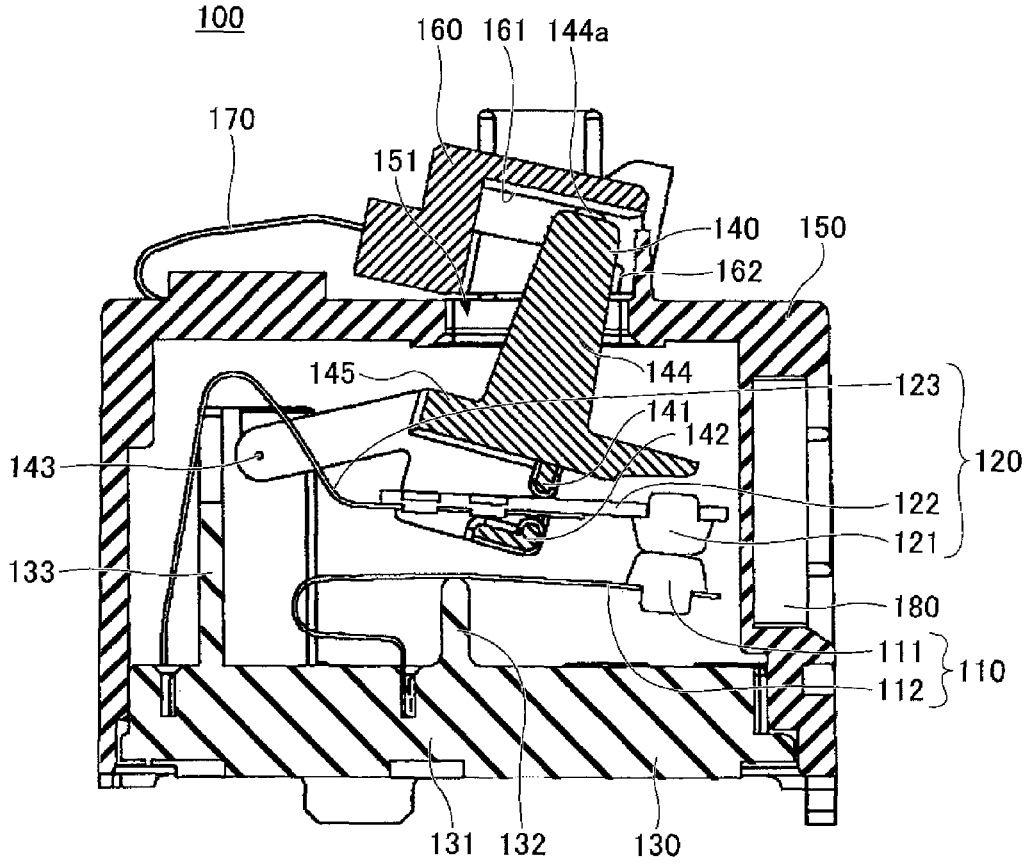
FIG. 24 is a drawing illustrating a configuration of the switch (ON state)

To turn on the switch 100, the sliding operation part 40 is slid to press the button 160 and cause the card 140, whose contact part **144*a* is in contact with the inner wall 161 of the button 160, to rotate around the rotational shaft 143. As a result, a downward force is applied via the upper contact part 141 to the movable plate 122 of the movable part 120, and the movable contact 121 is brought into contact with the fixed contact 111. FIG. 24 illustrates the switch 100 in this state. As described later, this state of the switch 100 is maintained by a contact slide contact part of a contact slide part (not shown), and the contact between the movable contact 121 and the fixed contact 111** is maintained so that electric power is supplied from a power supply.

To turn off the switch 100, the sliding operation part 40 is slid to move away from the button 160, and the button 160 is caused to return to an OFF state by the restoring force of the opening spring 170. As a result, as illustrated by FIG. 23, the card 140, whose contact part **144*a* is in contact with the inner wall 161 of the button 160, rotates around the rotational shaft 143, and an upward force is applied via the lower contact part 142 to the movable plate 122 of the movable part 120. More specifically, when the button 160 returns to the OFF state, a step 162 formed on an inner wall of the button 160 engages a protrusion (not shown) formed on the card 140 and lifts the card 140. The card 140 rotates around the rotational shaft 143 and an upward force is applied via the lower contact part 142 to the movable plate 122. The upward force applied to the movable plate 122 causes the movable contact 121 to move away from the fixed contact 111 and as a result, the supply of electric power from the power supply is stopped. When the movable contact 121 moves away from the fixed contact 111, an arc may be generated between the movable contact 121 and the fixed contact 111. To scatter the arc by a magnetic field, a permanent magnet 180 is provided near a contact position between the movable contact 121 and the fixed contact 111. The permanent magnet 180** generates a magnetic field in a direction that is substantially perpendicular to the direction in which the arc is generated.

When shutting off the supply of electric power from the power supply with the switch 100, the switch 100 is turned off by the restoring force of the opening spring 170 provided outside of the switch case 150, instead of by the restoring force of the movable spring 123 of the movable part 120. This configuration makes it possible to turn off the power even when the movable spring 123 of the movable part 120 has no restoring force. Also with this configuration, even when a part of the movable spring 123 melts due to heat and the function of the movable spring 123 is lost, it is possible to turn off the power by the restoring force of the opening spring 170 without using the restoring force of the movable spring 123. Thus, this configuration makes it possible to reliably shut off the supply of electric power from the power supply. Also, the opening spring 170 disposed outside of the switch case 150 is not affected by heat, unlike the fixed part 110 and the movable part 120 that may be affected by heat in the switch case 150.

Also in the switch 100, the insulating wall 133 is provided at a position between a part of the base block 130 to which the second end of the fixed spring 112 is connected and a part of the base block 130 to which the second end of the movable spring 123 is connected. Even when the fixed part 110 and the movable part 120 are melted by heat, the insulating wall 133 separates a melted part of the fixed part 110 from a melted part of the movable part 120. Accordingly, the insulating wall 133 prevents the melted parts of the fixed part 110 and the movable part 120 from fusing with each other and allowing an electric current to continuously flow.

According to the present embodiment, the sliding operation part 40 is provided on a side surface of the connector that is adjacent to a surface to be connected with the plug connector 200. Providing the sliding operation part 40 on a side surface makes it possible to reduce the size of the connector and improve the operability. When the sliding operation part 40 is provided on the surface to be connected with the plug connector 200, the plug connector 200 may prevent smooth operation of the sliding operation part 40 and makes it difficult to quickly stop the supply of electric power. On the other hand, when the sliding operation part 40 is provided on a side surface adjacent to the surface to be connected with the plug connector 200, it is easier to operate the sliding operation part 40 and the operability is improved.

The connector of the present embodiment has a substantially cuboid shape, and one of the surfaces of the cuboid shape is connected with the plug connector 200. The sliding operation part 40 may be provided on a surface other than the surface to be connected with the plug connector 200. In other words, the sliding operation part 40 may be provided on one of the surfaces that are adjacent to the surface to be connected with the plug connector 200 or on the bottom surface.

Second Embodiment

Figure 25:
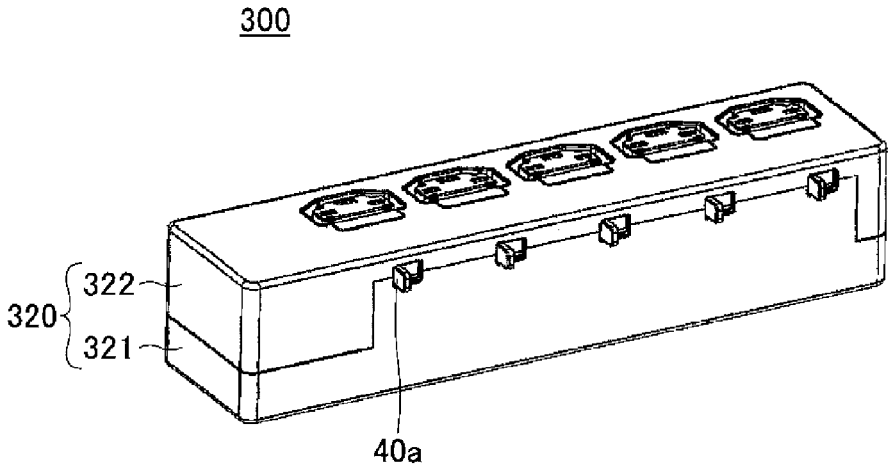
FIG. 25 is a perspective view of a connector bar according to a second embodiment.
Figure 26:
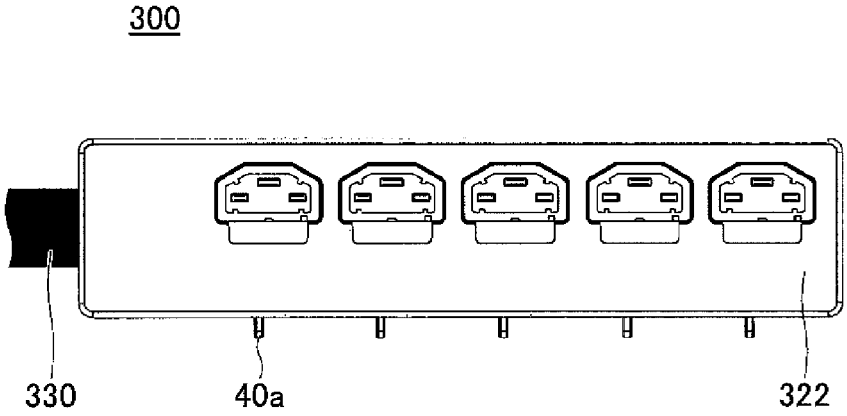
FIG. 26 is a top view of the connector bar according to the second embodiment.
Figure 27:
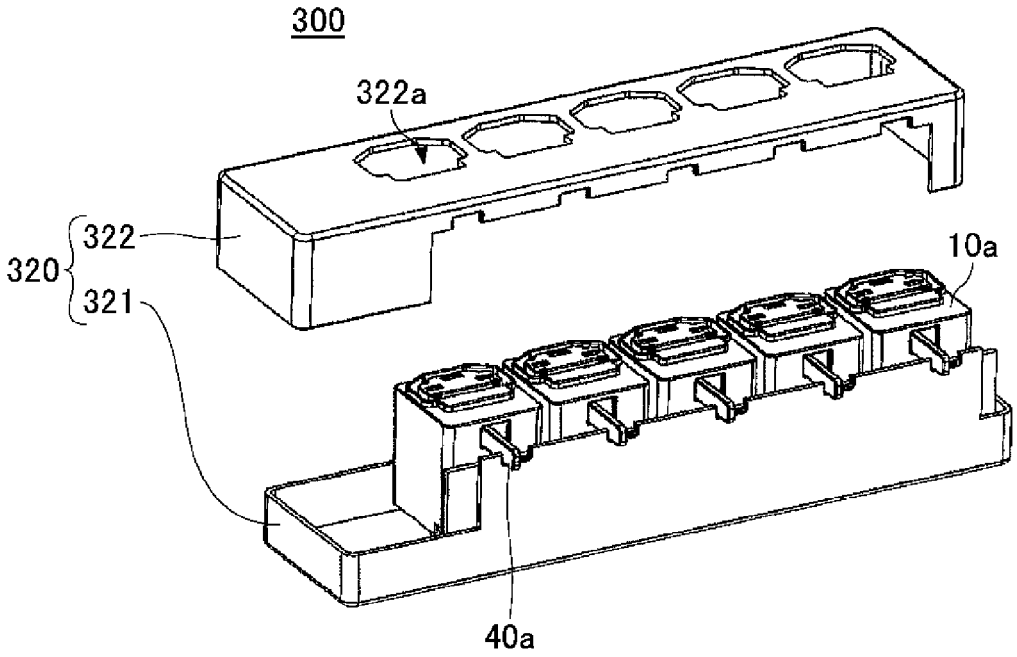
FIG. 27 is an exploded perspective view of the connector bar according to the second embodiment.
Figure 28:
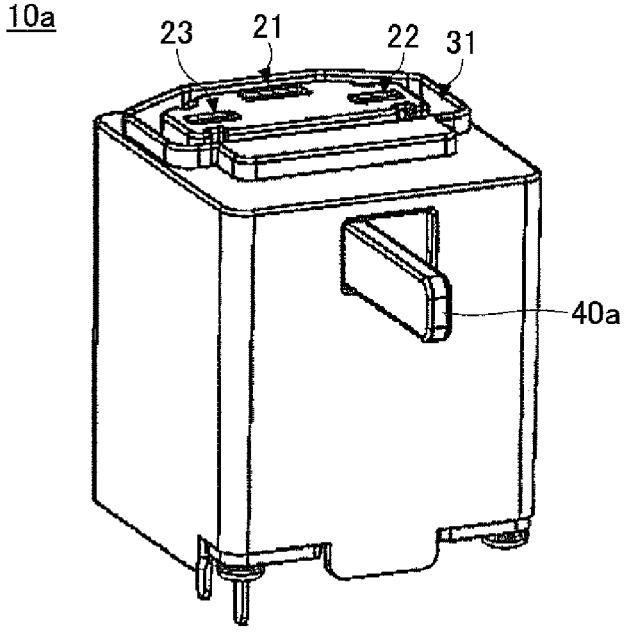
FIG. 28 is a perspective view of a connector used for the connector bar of the second embodiment.

Next, a second embodiment is described. A connector bar 300 of the second embodiment includes multiple connectors 10*a* having a configuration similar to that of the connector 10 of the first embodiment, and a housing 320 covering the connectors. The connector bar 300 is connected to a power cable 330. As illustrated by FIGS. 25 through 27, the connectors 10*a* having a configuration similar to that of the connector 10 of the first embodiment are arranged one-dimensionally in the housing 320 such that sliding operation parts 40*a* are arranged on the same surface. FIG. 25 is a perspective view, FIG. 26 is a top view, and FIG. 27 is an exploded perspective view of the connector bar 300 of the present embodiment. FIG. 28 is a perspective view of the connector 10*a* of the connector bar 300 of the present embodiment. In FIGS. 25 and 27, the power cable 330 is omitted. The housing 320 includes a lower housing part 321 and an upper housing part 322. The upper housing part 322 has openings 322*a* at positions corresponding to the surfaces of the connectors 10*a* to be connected with the plug connectors 200. Also, openings for exposing the sliding operation parts 40*a* of the connectors 10*a* are formed at a border between the lower housing part 321 and the upper housing part 322.

<First Variation of Connector Bar>

Figure 29:
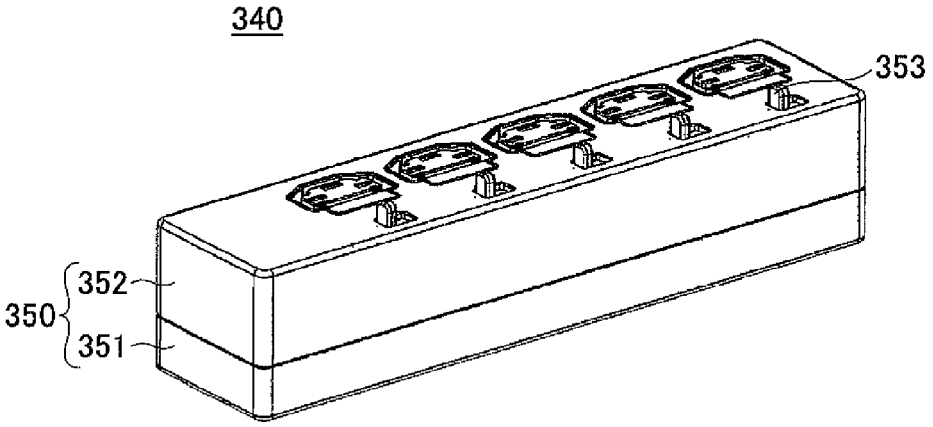
FIG. 29 is a perspective view (1) of another connector bar according to the second embodiment.
Figure 30:
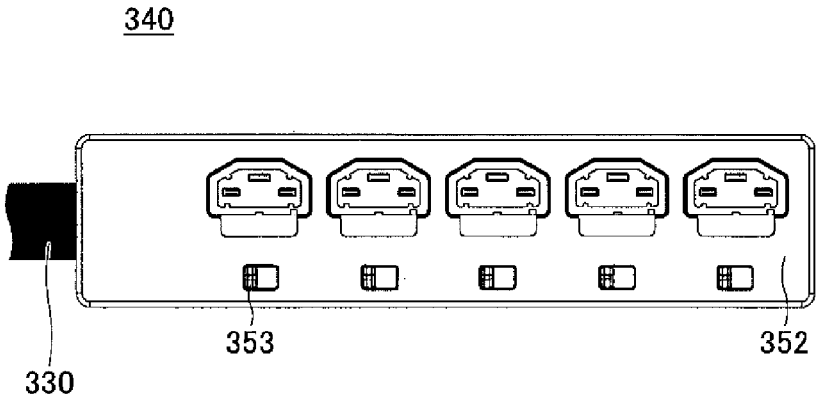
FIG. 30 is a top view (1) of the other connector bar according to the second embodiment.
Figure 31:
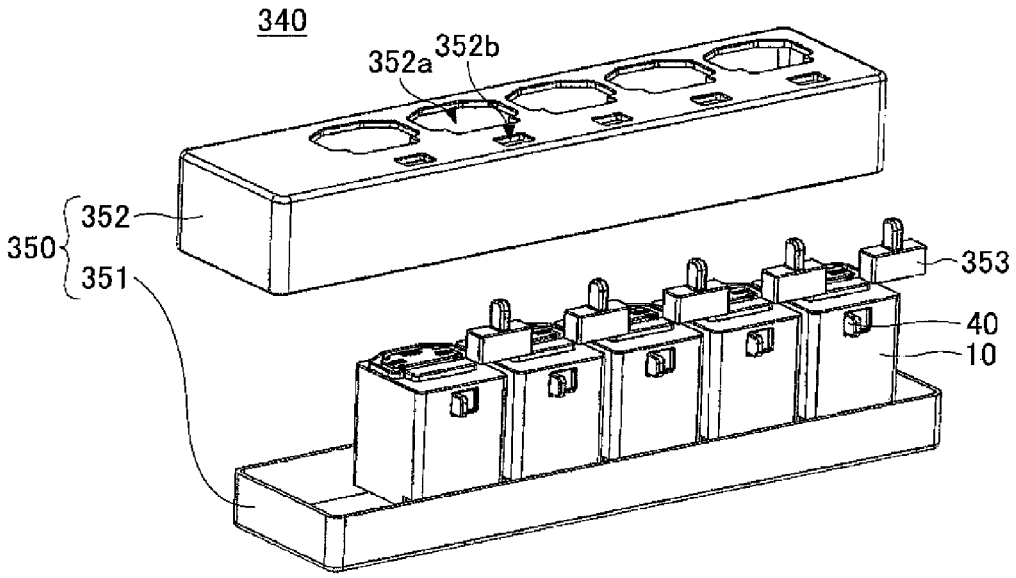
FIG. 31 is an exploded perspective view (1) of the other connector bar according to the second embodiment.

A connector bar 340 according to a first variation of the second embodiment is described below. The connector bar 340 includes multiple connectors 10 of the first embodiment, and a housing 350 covering the connectors 10. The connector bar 340 is connected to a power cable 330. As illustrated by FIGS. 29 through 31, multiple connectors 10 of the first embodiment are arranged one-dimensionally in the housing 350 such that sliding operation parts 40 are arranged on the same surface. FIG. 29 is a perspective view, FIG. 30 is a top view, and FIG. 31 is an exploded perspective view of the connector bar 340 of the present embodiment. In FIGS. 29 and 31, the power cable 330 is omitted.

The housing 350 includes a lower housing part 351 and an upper housing part 352. The upper housing part 352 has openings 352*a* at positions corresponding to the surfaces of the connector 10*a* to be connected with the plug connectors 200. Also, switch operation parts 353 each corresponding to one of the sliding operation parts 40 are provided in the upper housing part 352. The switch operation parts 353 are used to turn on and off the corresponding sliding operation parts 40. With the connector bar 340, although detailed explanation is omitted, the sliding operation parts 40 can be slid to the ON and OFF positions by sliding the switch operation parts 353. The upper housing part 352 also has openings 352*b* for exposing parts of the switch operation parts 353 to be operated.

<Second Variation of Connector Bar>

Figure 32:
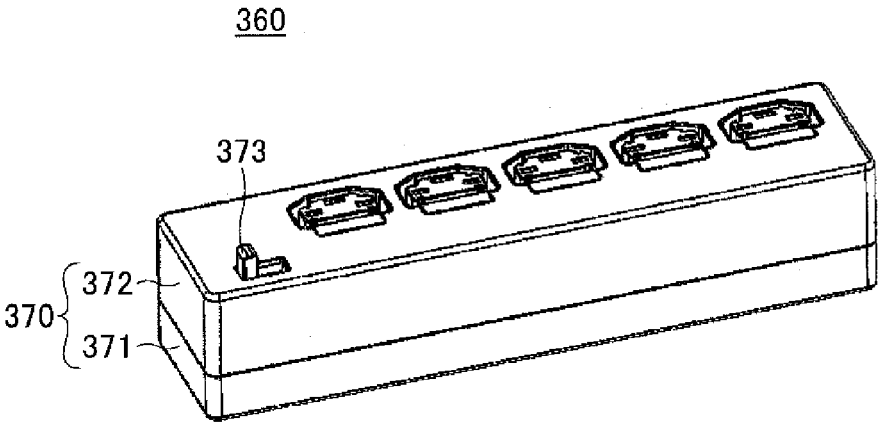
FIG. 32 is a perspective view (2) of the other connector bar according to the second embodiment.
Figure 33:
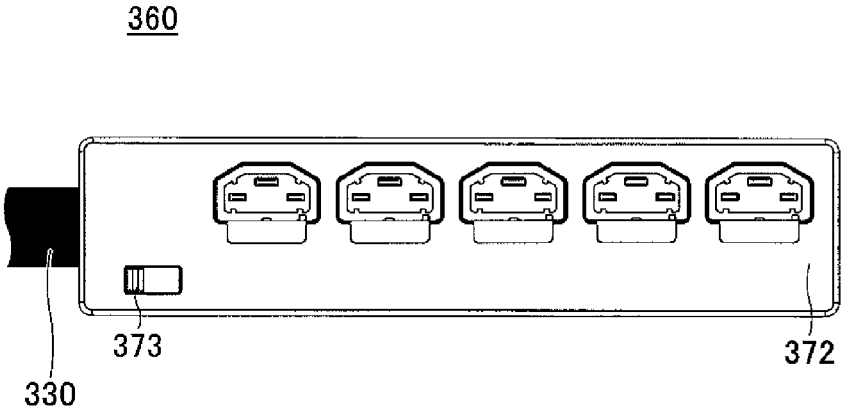
FIG. 33 is a top view (2) of the other connector bar according to the second embodiment.
Figure 34:
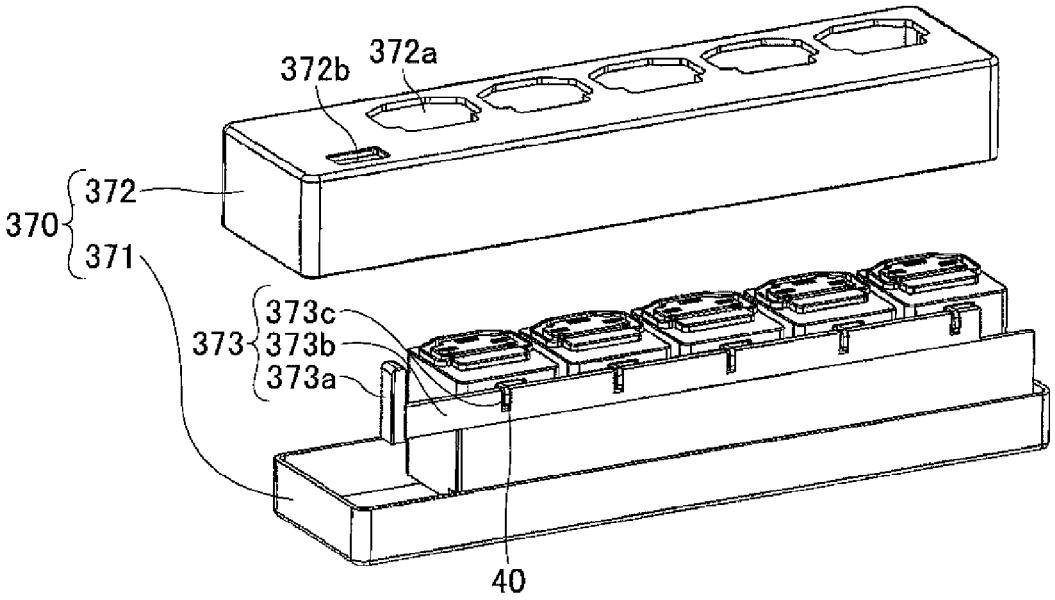
FIG. 34 is an exploded perspective view (2) of the other connector bar according to the second embodiment.

A connector bar 360 according to a second variation of the second embodiment is described below. The connector bar 360 includes multiple connectors 10 of the first embodiment, and a housing 370 covering the connectors 10. The connector bar 360 is connected to a power cable 330. As illustrated by FIGS. 32 through 34, multiple connectors 10 of the first embodiment are arranged one-dimensionally in the housing 370 such that sliding operation parts 40 are arranged on the same surface. FIG. 32 is a perspective view, FIG. 33 is a top view, and FIG. 34 is an exploded perspective view of the connector bar 360. In FIGS. 32 and 34, the power cable 330 is omitted.

The housing 370 includes a lower housing part 371 and an upper housing part 372. The upper housing part 372 has openings 372*a* at positions corresponding to the surfaces of the connector 10 to be connected with the plug connectors 200. Also, a switch operation part 373 is provided in the upper housing part 372. The switch operation part 373 is used to turn on and off multiple sliding operation parts 40 at the same time. The switch operation part 373 includes an operation part 373*a* to be operated and a bar 373*b*. Slits 373*c* corresponding to the sliding operation parts 40 are formed in the bar 373*b*. When the operation part 373*a* of the switch operation part 373 is slid, the sliding operation parts 40 engaging the corresponding slits 373*c* are slid at the same time via the bar 373*b*. This configuration makes it possible to slide the sliding operation parts 40 to the ON positions or the OFF positions at the same time. The upper housing part 372 also has an opening 372*b* for exposing a part of the operation part 373*a* of the switch operation part 373.

Embodiments of the present invention are described above. However, the present invention is not limited to the specifically disclosed embodiments, and variations and modifications may be made without departing from the scope of the present invention.

The present application is based on and claims the benefit of priority of Japanese Patent Application No. 2011-176410 filed on Aug. 11, 2011, the entire contents of which are hereby incorporated herein by reference.

EXPLANATION OF REFERENCES

10 Connector
10*a* Connector
21 Jack opening
22 Jack opening
23 Jack opening
31 Groove
40 Sliding operation part
50 Case
61 Jack terminal
62 Jack terminal
63 Jack terminal

300 Connector bar
320 Housing
321 Lower housing part
322 Upper housing part
322*a* Opening
330 Power cable

The invention claimed is:

1. A connector, comprising:

a connecting terminal to be connected with another connector;

a fixed contact;

a movable plate;

a movable contact provided at an end of the movable plate;

a sliding operation part that is slidable in a first direction and in a second direction opposite to the first direction, for controlling a contact between the fixed contact and the movable contact;

a button that is pressed and moves from an off position in a third direction when the sliding operation part is moved in the first direction;

a card that contacts with the button and moves the movable plate when the button is pressed; and a spring connected to the button;

wherein the connector is configured such that when the sliding operation part is moved in the first direction, the button is pressed, the card is moved by the button, the movable plate is moved via the card to bring the movable contact into contact with the fixed contact, and the connector is turned on, and when the sliding operation part is moved in the second direction, the movable contact is caused to move away from the fixed contact as the button is moved to the off position by a restoring force of the spring, and the connector is turned off.

2. The connector as claimed in claim 1, wherein the fixed contact comprises a plurality of fixed contacts and the movable contact comprises a plurality of movable contacts; and when the button is pressed, the movable contacts are brought into contact with the corresponding fixed contacts at a same time.

3. The connector as claimed in claim 1, wherein the card is configured to rotate around a rotational shaft when the button is pressed.

4. A connector bar, comprising:

a plurality of connectors each of which includes a connecting terminal to be connected with another connector, a fixed contact, a movable plate, a movable contact provided at an end of the movable plate, a card that contacts the movable plate, a button that contacts the card, a spring connected to the button, and a sliding operation part for controlling a contact between the fixed contact and the movable contact; and a switch operation part that causes the sliding operation part of each of the connectors to slide, wherein each connector of the connectors is configured such that when the sliding operation part is moved in a first direction, the button is pressed, the movable plate is moved via the card to bring the movable contact into contact with the fixed contact, and the connector is turned on, and when the sliding operation art is moved in a second direction opposite to the first direction, the movable contact is caused to move away from the fixed contact by a restoring force of the spring, and the connector is turned off.

5. The connector bar as claimed in claim 4, wherein the sliding operation parts of the connectors are provided on a same surface of the connector bar.

6. The connector bar as claimed in claim 3, wherein the switch operation part includes an operation part and a bar connected to the operation part; and the switch operation part is configured such that the sliding operation parts are caused to slide at a same time by the bar when the operation part is operated.

7. A connector to be connected with another connector, the connector comprising:

a fixed contact;

a movable plate;

a movable contact that is provided on the movable plate and movable to contact the fixed contact;

a sliding part that is slidable in a first direction and a second direction opposite to the first direction;

a button that is movable in a pressed direction and an opposite direction opposite to the pressed direction according to movement of the sliding part;

a spring that biases the button in the opposite direction; and a card that moves according to movement of the button and causes the movable plate to move in a direction to bring the movable contact into contact with the fixed contact and in a direction to move the movable contact away from the fixed contact, wherein when the sliding part slides in the first direction, the button is caused by the sliding part to move in the pressed direction, and the card moves according to the movement of the button and causes the movable plate to move in the direction to bring the movable contact into contact with the fixed contact; and wherein when the sliding part slides in the second direction, the button is caused by the bias of the spring to move in the opposite direction, and the card moves according to the movement of the button and causes the movable plate to move in the direction to move the movable contact away from the fixed contact.

8. The connector as claimed in claim 7, wherein the card is configured to rotate around a rotational shaft when the button is pressed.

* * * * *